US007756455B2

(12) United States Patent
Mori et al.

(10) Patent No.: US 7,756,455 B2
(45) Date of Patent: Jul. 13, 2010

(54) IMAGE FORMING APPARATUS HAVING INTERMEDIATE TRANSFER MEMBER WITH RESIDUAL SURFACE POTENTIAL CHARACTERISTIC

(75) Inventors: Tomohide Mori, Okazaki (JP); Yasuyuki Inada, Toyokawa (JP); Toshiaki Hiroi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 269 days.

(21) Appl. No.: 12/102,309

(22) Filed: Apr. 14, 2008

(65) Prior Publication Data

US 2009/0074477 A1 Mar. 19, 2009

(30) Foreign Application Priority Data

Apr. 24, 2007 (JP) ..... 2007-114118

(51) Int. Cl.
*G03G 15/01* (2006.01)

(52) U.S. Cl. ..... 399/302

(58) Field of Classification Search ..... 399/66, 399/299, 302, 308; 430/125.32
See application file for complete search history.

(56) References Cited

U.S. PATENT DOCUMENTS 5,243,392 A * 9/1993 Berkes et al. ..... 399/308
6,922,542 B2 * 7/2005 Mizuno et al. ..... 399/302
7,215,912 B2 * 5/2007 Yamaguchi et al. ..... 399/302
7,330,686 B2 * 2/2008 Nakano et al. ..... 399/302
7,343,128 B2 * 3/2008 Song et al. ..... 399/302
7,639,976 B2 * 12/2009 Yoshida ..... 399/302
2007/0134029 A1 * 6/2007 Sawai ..... 399/302

FOREIGN PATENT DOCUMENTS

JP 64-074571 3/1989
JP 10312116 A * 11/1998
JP 2004-157265 A 6/2004
JP 2006113285 A * 4/2006

OTHER PUBLICATIONS

Notification of Reasons for Refusal in JP 2007-114118 dated Jan. 27, 2009, and an English Translation thereof.

* cited by examiner

*Primary Examiner*—Robert Beatty
(74) *Attorney, Agent, or Firm*—Buchanan Ingersoll & Rooney PC

(57) ABSTRACT

An image-forming apparatus, equipped with an intermediate transfer member 3 having a surface layer that holds a toner image primary-transferred from a latent image-supporting member temporarily on the surface layer and allows secondary transfer of the toner image held thereon to an image receiving medium, wherein, when the moving distance of the intermediate transfer member surface from the secondary transfer region 15 to the first primary-transfer region 16 is designated as L (mm) and the moving speed of the intermediate transfer member as S (mm/second), the residual surface potential of the intermediate transfer member L/S seconds after application of the secondary transfer voltage is 1/20 or less of the first primary transfer voltage V1.

12 Claims, 3 Drawing Sheets

IMAGE FORMING APPARATUS HAVING INTERMEDIATE TRANSFER MEMBER WITH RESIDUAL SURFACE POTENTIAL CHARACTERISTIC

This application is based on application(s) No. 2007-114118 filed in Japan, the contents of which are hereby incorporated by reference.

BACKGROUND OF THE INVENTION

1. Field of the Invention

The present invention relates to an image-forming apparatus for use in monochromic/full-color copying machines, printers, fax machines, multifunctional processing machines thereof etc.

2. Description of the Related Art

In a full-color image-forming apparatus in the intermediate transfer process, a color image is formed, for example, by once transferring toner images different in color that are developed on multiple photosensitive members onto an intermediate transfer member to be superimposed and transferring the superposed toner images all together onto an image receiving medium such as paper. The transferring process from photosensitive member to intermediate transfer member is called primary transfer, while that from intermediate transfer member to image receiving medium, secondary transfer. In these image transfer processes, the toner is driven to transfer in an electric field formed by applying bias voltages, for example, to the transfer rollers. For example, primary transfer voltage is applied to the primary-transfer roller in the primary transfer process, while secondary transfer voltage, to the secondary-transfer roller in the secondary transfer process, for transfer of the toner.

In such an image-forming apparatus, the surface of the intermediate transfer member is electrified by application of the secondary transfer voltage in the secondary transfer process. However, electrification of the intermediate transfer member surface is not uniform in the secondary transfer process. For example when paper in smaller size is fed, the intermediate transfer member becomes in contact directly with the secondary-transfer roller in the peripheral regions and indirectly via the paper in the central region, and thus, the surface of the intermediate transfer member surface is charged unevenly. Even in the region where the intermediate transfer member becomes in contact via paper with the secondary-transfer roller, an area in image region where the toner is present in a relatively greater amount, for example, is resistant to electrification of the intermediate transfer member surface, while an area such as white area where the toner is present in a relatively smaller amount is electrified more readily. Thus when the intermediate transfer member surface is electrostatically charged unevenly, the electrostatic charge distribution on the surface forms a latent image, causing formation of residual images thereof (irregularity in density) in next images.

Accordingly proposed is a method of preventing such transfer irregularity, by reducing the residual potential of the intermediate transfer member to ½ or less before the subsequent transfer (Japanese Unexamined Patent Publication No. 2004-157,265). However, it is not possible to prevent the residual image sufficiently even by such a method.

On the other hand, an intermediate transfer member having a surface layer, which is made of a material different from that for the substrate, formed on the outermost surface have been used recently for improvement in image quality. The surface layer, which is formed for improvement of roughness, hardness and surface properties such as toner release characteristics of the intermediate transfer member surface, often has electrical properties different from those of the substrate. The intermediate transfer member having such a surface layer may become significantly law in static elimination, depending on the lamination conditions of the surface layer, and thus, may generate more remarkably residual toner images described above.

BRIEF SUMMARY OF THE INVENTION

An object of the present invention is to provide an image-forming apparatus which can prevent image noises caused by residual images, even when an intermediate transfer member having a surface layer is used.

The present invention provide an image-forming apparatus, equipped with an intermediate transfer member having a surface layer that holds a toner image primary-transferred from a latent image-supporting member temporarily on the surface layer and allows secondary transfer of the toner image held thereon to an image receiving medium, wherein, when the moving distance of the intermediate transfer member surface from the secondary transfer region to the first primary-transfer region is designated as L (mm) and the moving speed of the intermediate transfer member as S (mm/second), the residual surface potential of the intermediate transfer member L/S seconds after application of the secondary transfer voltage is 1/20 or less of the first primary transfer voltage V1.

DETAILED DESCRIPTION OF THE INVENTION

The present invention relates to an image-forming apparatus, equipped with an intermediate transfer member having a surface layer that holds a toner image primary-transferred from a latent image-supporting member temporarily on the surface layer and allows secondary transfer of the toner image held thereon to an image receiving medium, wherein, when the moving distance of the intermediate transfer member surface from the secondary transfer region to the first primary-transfer region is designated as L (mm) and the moving speed of the intermediate transfer member as S (mm/second), the residual surface potential of the intermediate transfer member L/S seconds after application of the secondary transfer voltage is 1/20 or less of the first primary transfer voltage V1.

EFFECT OF THE INVENTION

According to the image-forming apparatus of the present invention, it is possible to prevent image noises caused by residual images sufficiently even when an intermediate transfer member having a surface layer is used.

The image-forming apparatus according to the present invention has an intermediate transfer member temporarily holding a toner image primary-transferred from a latent image-supporting member and allowing secondary transfer of the toner image held thereon to an image receiving medium. Hereinafter, the image-forming apparatus according to the present invention will be described, by taking a tandem full-color image-forming apparatus having multiple latent image-supporting members in respective development units for each color forming a toner image on a latent image-supporting member as an example, but the apparatus may be in any structure, if it has an intermediate transfer member, and may be, for example, a four-cycle full-color image-forming apparatus having only one latent image-supporting member for development units of each color.

Figure 1:
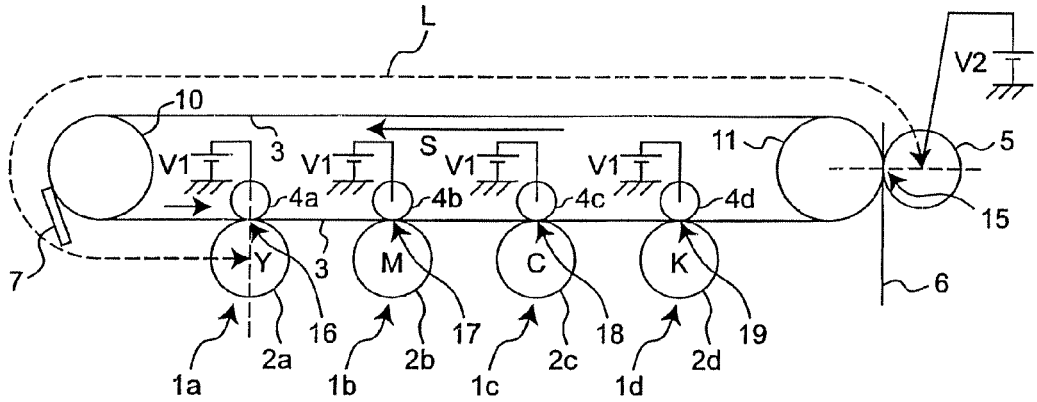
FIG. 1 is a schematic view illustrating the configuration of an image-forming apparatus in an embodiment of the present invention.

FIG. 1 is a schematic view illustrating the configuration of an image-forming apparatus in an embodiment of the present invention. Normally in such a tandem full-color image-forming apparatus shown in FIG. 1, at least an electrostatically charging device, an exposure device, a developing device, a cleaning device (none of the devices are shown in Figure) and others are placed around each latent image-supporting member (2*a*, 2*b*, 2*c*, or 2*d*) in each development unit (1*a*, 1*b*, 1*c*, or 1*d*). Each development unit (1*a*, 1*b*, 1*c*, or 1*d*) is placed in parallel with an intermediate transfer member 3, which is stretched by at least two tension rollers (10 and 11). In each development unit, a toner image formed on the surface of the latent image-supporting member (2*a*, 2*b*, 2*c*, or 2*d*) is primary-transferred by each primary-transfer roller (4*a*, 4*b*, 4*c*, or 4*d*) onto the intermediate transfer member 3, with the respective images being superimposed on the intermediate transfer member to form a full-color image. The full-color image transferred on the surface of the intermediate transfer member 3 is secondary-transferred by a secondary-transfer roller 5 together onto an image receiving medium 6 such as paper, and fixed on the image receiving medium by passing through a fixing device (not shown in the Figure). On the other hand, the non-transferred toner remaining on the intermediate transfer member is removed by a cleaning device 7.

The latent image-supporting member (2*a*, 2*b*, 2*c*, or 2*d*) is a so-called photosensitive member giving a toner image, based on an electrostatic latent image formed on the surface. The latent image-supporting member is not particularly limited, if it can be used in conventional image-forming apparatuses, but normally, the one having an organic photosensitive layer is used.

The intermediate transfer member 3 receives the toner image formed on each latent image-supporting member on its surface (primary transfer) in each development unit and transfers the toner image formed on the surface onto an image receiving medium (secondary transfer) repeatedly. In primary-transfer region (16, 17, 18, or 19), the toner image on the latent image-supporting member is transferred electrically onto the intermediate transfer member 3, by application of primary transfer voltage V1 to each primary-transfer roller (4*a*, 4*b*, 4*c*, or 4*d*). In a secondary transfer region 15, the toner image on the intermediate transfer member is transferred electrically onto the image receiving medium 6, by application of secondary transfer voltage V2 to the secondary-transfer roller 5.

In the present invention, the intermediate transfer member 3, the primary transfer voltage V1 and the secondary transfer voltage V2 are so selected that, when the moving distance of the intermediate transfer member surface from the secondary transfer region 15 to the first primary-transfer region 16 is designated as L (mm) as shown in FIG. 1 and the moving speed of the intermediate transfer member S (mm/second), the residual potential on the intermediate transfer member 3 L/S seconds after application of the secondary transfer voltage becomes 1/20 or less of the first primary transfer voltage V1, in particular 1/700 to 1/20, preferably 1/100 to 1/20. Thereby, it is possible to prevent image noises due to residual images, even when an intermediate transfer member having a surface layer is used. If the residual potential of the intermediate transfer member after L/S seconds is larger than 1/20 of the first primary transfer voltage V1, an earlier image appears as residual image (causing irregularity in density) when copied continuously. The first primary transfer voltage V1 is the primary transfer voltage applied in the primary-transfer region 16 located most upstream in the moving direction of the intermediate transfer member. The number of the development units 1, the latent image-supporting members 2, the primary-transfer rollers 4, or others is 4 in FIG. 1, but is not limited to 4, and, for example, may be 1. When the apparatus has, for example, one development unit 1, one latent image-supporting member 2, and one primary-transfer roller 4, the primary transfer voltage V1 applied in the primary-transfer region where the latent image-supporting member 2 and the intermediate transfer member 3 are in contact with each other and the residual potential on the intermediate transfer member surface satisfy the relationship above.

The residual potential on the intermediate transfer member surface after L/S seconds can be determined in the following way:

An intermediate transfer member is separated from an image-forming apparatus into HH environment and connected to a jig that can be driven at any speed therein, and a secondary-transfer roller is brought into contact therewith under the same condition as that in the image-forming apparatus. The intermediate transfer member surface is charged electrostatically, while the jig is driven at a speed of S (mm/s) and a predetermined secondary transfer voltage is applied to the secondary-transfer roller by using a high-pressure power supply manufactured by Trek, Inc. The residual potential of the intermediate transfer member at the position L (mm) downstream of the position where the secondary-transfer roller is brought into contact is determined with a surface potentiometer manufactured by Trek, Inc.

The moving distance L of the intermediate transfer member surface from the secondary transfer region 15 to the first primary-transfer region 16 and the moving speed S of the intermediate transfer member are parameters determined according to the dimension of the image-forming apparatus, the system speed, and others, and thus are not particularly limited. For example, L is set normally in the range of 50 to 700 mm, while S normally in the range of 30 to 300 mm/second.

In the present invention, the intermediate transfer member 3 has a surface layer on the external surface. An intermediate transfer belt is shown as an intermediate transfer member 3 in FIG. 1, but it is not particularly limited thereto, if it has a surface layer on the external surface, and it may be, for example, a so-called intermediate transfer drum.

Figure 2:
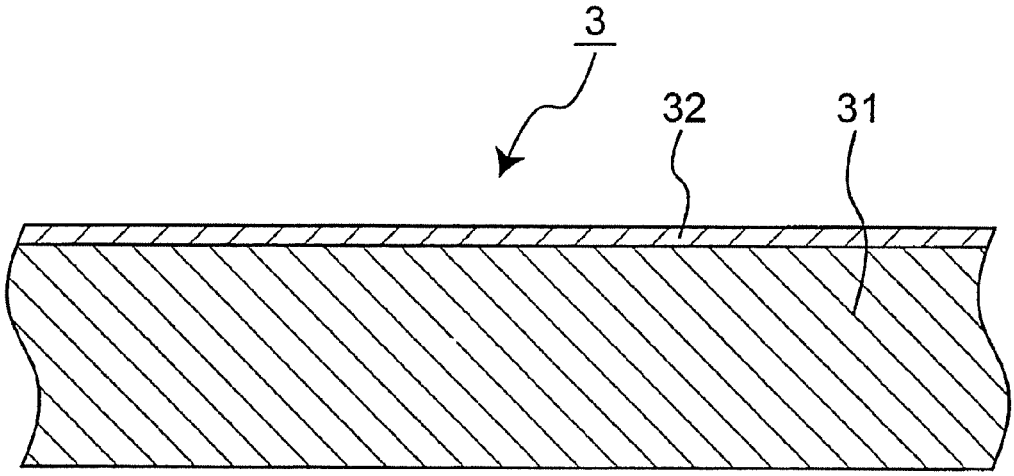
FIG. 2 is a schematic sectional view illustrating the layer structure of the intermediate transfer member.

The intermediate transfer member according to the present invention will be described below, by taking an intermediate transfer member 3 in seamless belt shape as an example. FIG. 2 is a schematic sectional view illustrating the layer structure of an intermediate transfer belt 3.

The intermediate transfer belt 3 has at least a substrate 31 and a surface layer 32 formed on the surface of the substrate 31.

The substrate 31 is not particularly limited, but materials having a surface resistivity in the range of $10^6$ to $10^{12}\Omega/\square$ are preferable; and the substrate is normally in the seamless belt shape. Favorably used is, for example, a mixture of one of resin materials (including polycarbonate (PC); polyimide (PI); polyphenylene sulfide (PPS); polyamide-imide (PAI); fluorine resins such as polyvinylidene fluoride (PVDF) and tetrafluoroethylene-ethylene copolymers (ETFE); urethane resins such as polyurethane; and polyamide resins such as polyamide-imide) or rubber materials (including ethylene-propylene-diene rubber (EPDM); nitrile-butadiene rubber (NBR); chloroprene rubber (CR); silicone rubber; and urethane rubber), with a conductive filler such as carbon, zinc antimonate, tin oxide, zinc oxide, potassium titanate, a metal oxide such as indium oxide, the mixed oxide thereof, or ionic conductive material. The thickness of the substrate is normally adjusted to approximately 50 to 200 μm when it is a resin material, and to approximately 300 to 700 μm when it is a rubber material.

The intermediate transfer belt 3 may have other one or more layers between the substrate 31 and the surface layer 32, and the surface layer 32 is formed as an outermost layer.

The substrate 31 may be surface-treated by a known surface treatment method, for example, by plasma treatment, flame treatment or UV irradiation, before the surface layer 32 is formed.

The surface layer 32 is not particularly limited, if it is a layer conventionally formed on intermediate transfer member surface for improvement of the roughness, durability (hardness), and surface properties such as toner release characteristic, and may be, for example, an inorganic layer of inorganic material or an organic layer of organic material. The thickness of the surface layer is preferably 5 μm or less, more preferably 10 nm or more and 5 μm or less, for prevention of cracking and exfoliation of the layer.

A hard release layer is used favorably as surface layer 32, for improvement of the durability (hardness) and the toner release characteristic of the intermediate transfer member surface.

The hardness of the hard release layer is normally 3 GPa or more, in particular 3 to 11 GPa.

The hardness in the present description is a hardness determined by nanoindentation method, for example, by using NANO Indenter XP/DCM (manufactured by MTS Systems and MTS NANO Instruments).

Typical examples of the hard release layers include inorganic oxide layers, hard carbon-containing layers, cured resin layers and the like.

The inorganic oxide layer preferably contains at least one oxide selected from $SiO_2$, $Al_2O_3$, $ZrO_2$, and $TiO_2$, and particularly $SiO_2$ is preferable. The inorganic oxide layer is preferably formed by plasma CVD of depositing and forming a layer corresponding to a raw gas by converting a mixed gas containing at least a discharge gas and a source gas for the inorganic oxide layer into the plasma state, particularly preferably by plasma CVD performed at atmospheric pressure or a pressure close to atmospheric pressure. The thickness of the inorganic oxide layer is not particularly limited, but preferably, for example, 10 to 500 nm.

Hereinafter, the production apparatus and the production method will be described by taking formation of an inorganic oxide layer of silicon oxide ($SiO_2$) by plasma CVD under atmospheric pressure, as an example. The atmospheric pressure or a pressure close to it is a pressure of approximately 20 to 110 kPa, and a pressure of 93 to 104 kPa is preferable for obtaining advantageous effects of the present invention.

Figure 3:
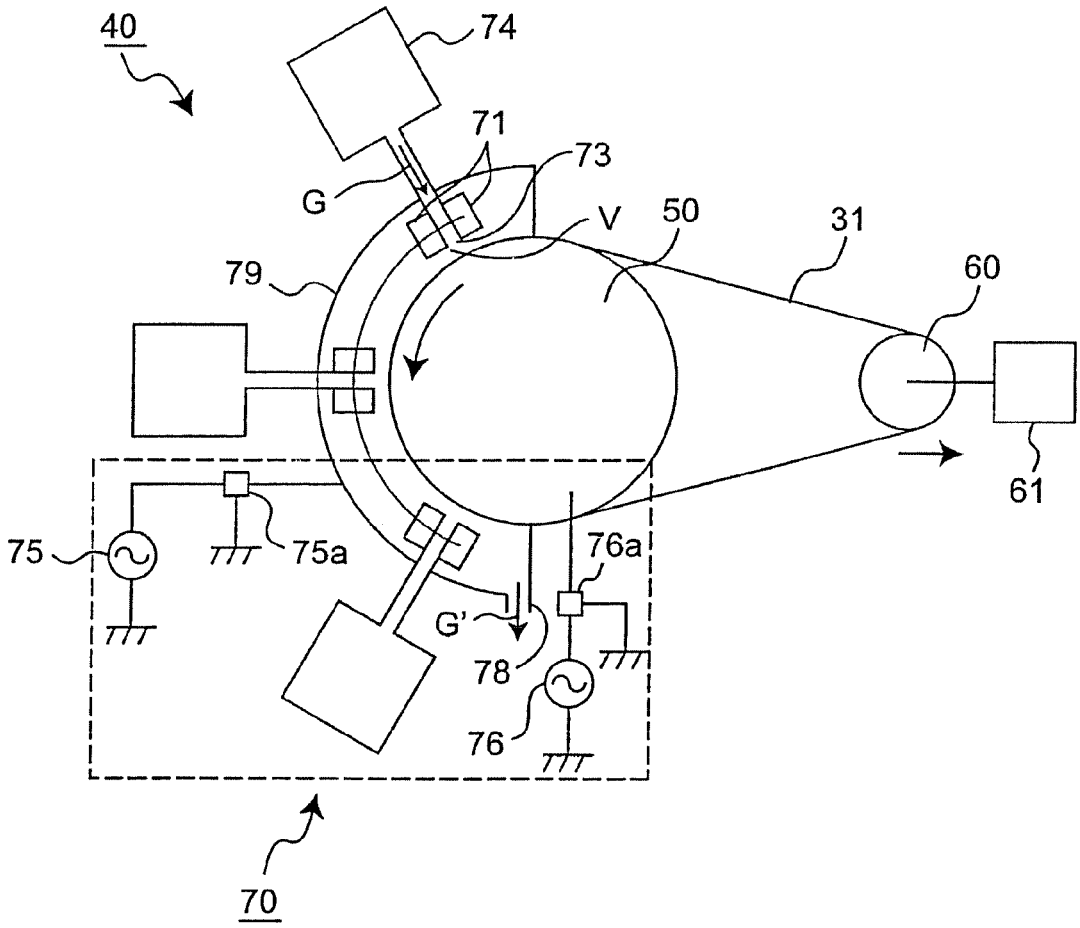
FIG. 3 is a view illustrating a production apparatus for producing an intermediate transfer member.

FIG. 3 is a view illustrating a production apparatus for production of an inorganic oxide layer. The production apparatus 40 for inorganic oxide layer above is an apparatus having a discharge space and a thin layer-depositing region almost in the same region in which an inorganic oxide layer is formed by deposition directly on a substrate while the substrate is exposed to plasma, and has an endless belt-shaped substrate 31, a roll electrode 50 and a driven roller 60, stretching and rotating it in the arrow direction and an atmospheric-pressure plasma CVD apparatus 70, i.e., a layer-forming apparatus forming an inorganic oxide layer on the substrate surface.

The atmospheric-pressure plasma CVD apparatus 70 has at least one set of fixed electrodes 71 disposed along the external surface of the roll electrode 50, a discharge space 73 between the fixed electrodes 71 and the roll electrode 50 for discharge, a mixed gas-supplying apparatus 74 of generating a mixed gas G containing at least a raw gas and a discharge gas and supplying the mixed gas G into the discharge space 73, a discharger container 79 preventing air flow into the discharge space 73 and others, a first power source 75 connected to the fixed electrodes 71, a second power source 76 connected to the roll electrode 50, and a outgas discharge unit 78 discharging the outgas G' after reaction. The second power source 76 may be connected to the fixed electrodes 71 and the first power source 75 to the roll electrode 50.

The mixed gas-supplying apparatus 74 supplies a mixed gas of a raw gas for forming a silicon oxide-containing layer and a rare gas such as nitrogen or argon into the discharge space 73.

The driven roller 60 is rotated by a tension-applying means 61 in the arrow direction, while applying a particular tension to the substrate 31. The tension-applying means 61 removes the tension applied, for example, during exchange of the substrate 31, for easy exchange of the substrate 31.

The first power source 75 outputs a voltage at a frequency of ω1 and a second power source 76, a voltage at a frequency of ω2, which is higher than the frequency ω1, and an electric field V in which frequencies ω1 and ω2 are superimpose is generated by these voltages in the discharge space 73. The mixed gas G is converted into the plasma state by the electric field V, and a layer (inorganic oxide layer) deposits on the surface of the substrate 31 according to the raw gas contained in the mixed gas G.

Alternatively, either the roll electrode 50 or the fixed electrode 71 may be grounded, and the other connected to a power source. In such a case, the second power source is preferably used as power source for production of a dense thin layer, particularly favorably when a rare gas such as argon is used as discharge gas.

The thickness of the inorganic oxide layer may be controlled by forming superimposed inorganic oxide layers by multiple fixed electrodes and mixed gas-supplying apparatuses located downstream in the rotation direction of the roll electrode among multiple fixed electrodes.

An inorganic oxide layer is formed by the fixed electrode and the mixed gas-supplying apparatus located most downstream in the rotation direction of the roll electrodes among the multiple fixed electrodes, and other layers, such as an adhesive layer for improvement of adhesiveness between inorganic oxide layer and substrate or the like, may be formed by other fixed electrodes and mixed gas-supplying apparatuses located more upstream.

For improvement of adhesiveness between inorganic oxide layer and substrate, the surface of the substrate may be activated by plasma treatment, by installing a gas supply apparatus supplying a gas such as argon, oxygen or hydrogen and fixed electrodes, at the position upstream of the fixed electrodes and the mixed gas-supplying apparatuses forming the inorganic oxide layer.

Typical examples of the hard carbon-containing layers include amorphous carbon layer, hydrogenated amorphous carbon layer, tetrahedral amorphous carbon layer, nitrogen-containing amorphous carbon layer, and metal-containing amorphous carbon layer and the like. The thickness of the hard carbon-containing layer is preferably similar to that of the inorganic oxide layer.

The hard carbon-containing layer can be prepared by a method similar to that for the inorganic oxide layer described above, specifically, by plasma CVD of depositing and forming a layer according to a raw gas by converting a mixed gas of at least a discharge gas and a raw gas into the plasma state, particularly by plasma CVD under atmospheric pressure or a pressure close to atmospheric pressure.

An organic compound gas that is gas or liquid at room temperature, in particular a hydrocarbon gas, is used as raw gas for forming the hard carbon-containing layer. The raw material may not be gaseous at normal temperature under normal pressure, and thus, may be liquid or solid, if it vaporizes, for example by melting, vaporization, or sublimation under heat or under reduced pressure, in the mixed gas-supplying apparatus. An example of the raw hydrocarbon gas for use is a gas containing at least one of hydrocarbon gases including paraffin hydrocarbons such as $CH_4$, $C_2H_6$, $C_3H_8$, and $C_4H_{10}$, acetylene-based hydrocarbons such as $C_2H_2$ and $C_2H_4$, olefinic hydrocarbons, diolefinic hydrocarbons, and aromatic hydrocarbons. Examples thereof other than the hydrocarbons include compounds containing at least carbon elements such as alcohols, ketones, ethers, esters, CO, and $CO_2$.

The cured resin layer is a resin layer prepared by coating a curable resin containing a dispersed conductive filler and hardening the resin by heat or light (UV). Materials for the conductive filler are the same as those for the conductive filler contained in the substrate. Any known resin curable in the field of resins may be used as curable resin, and examples thereof include acrylic UV-curing resin, polycarbonate UV-curing resin and the like. The thickness of the cured resin layer is not particularly limited, but preferably, for example, 0.5 to 5 μm, particularly preferably 3 to 5 μm.

Such curable resins are available as commercial products.

Examples of the acrylic UV-curing resins include Sanrad (manufactured by Sanyo Chemical Industries, Ltd) and others. Examples of the polycarbonate UV-curing resins include Iupilon (manufactured by Mitsubishi Gas Chemical Company, Inc.) and others.

The surface resistivity of the surface layer 32 is preferably higher than that of the substrate 31, for prevention of improper transfer of image and image roughness, and normally, in the range of $10^8$ to $10^{14}\Omega/\square$. The improper transfer of image indicates a state where the transferred image is not uniform entirely, causing defects in image quality such as irregularity in density and roughness.

The volume resistivity of the entire intermediate transfer member 3 may be normally in the range of $10^7$ to $10^{12}$ Ω·cm, but is preferably in the range of $2\times10^9$ to $1\times10^{12}$ Ω·cm for prevention of improper transfer of image.

The primary transfer voltage V1 is a DC voltage applied to each of the primary-transfer rollers (4*a*, 4*b*, 4*c*, and 4*d*). the primary transfer voltages V1 applied to respective primary-transfer rollers may be the same as or different from each other, if the residual potential on the intermediate transfer member 3 surface after L/S seconds and the voltage V1 applied in the first primary-transfer region satisfy the particular relationship above, but are normally the same as each other. For example, a voltage having a polarity opposite to that of the toner and an absolute value in the range of 300 to 3,000 V, particularly 600 to 1,500 V, is applied favorably as primary transfer voltage V1. The polarity opposite to that of the toner means +polarity, for example, when the toner has a negative polarity, and −polarity when the toner has a positive polarity. AC components may be superposed on the primary-transfer roller together with DC component.

Figure 4:
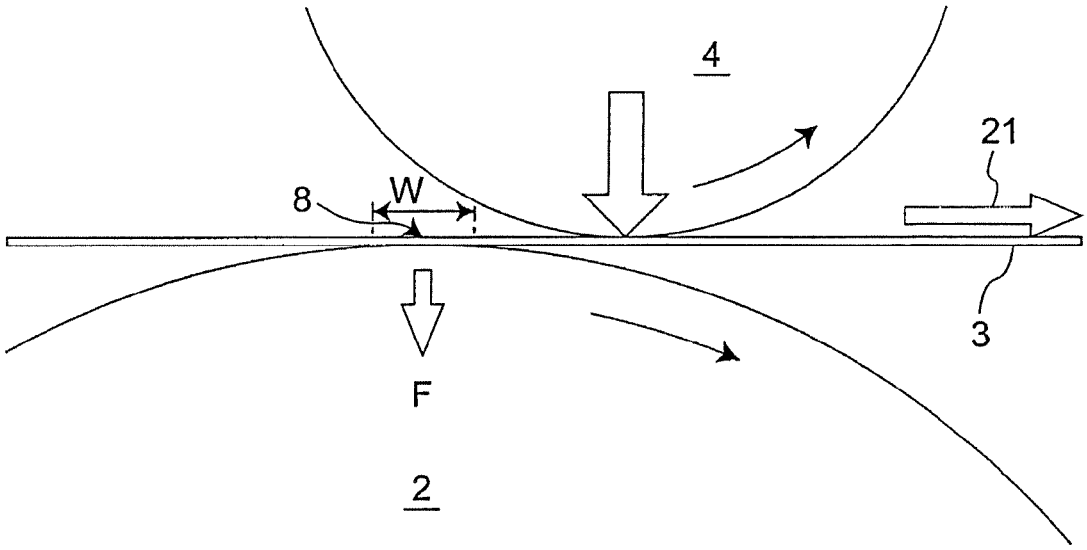
FIG. 4 is an expanded view of the region close to the primary-transfer region in an embodiment of the present invention.

The primary-transfer rollers 4 (4*a*, 4*b*, 4*c*, and 4*d*) are placed on the face of the intermediate transfer member 3 opposite to the latent image-supporting members 2; normally as shown in FIG. 4, each of them is placed at a position downstream of the contact area 8 between latent image-supporting member 2 and intermediate transfer member 3 in the moving direction of intermediate transfer member 21; and a transfer pressure F by intermediate transfer member 3 on the latent image-supporting member 2 is generated by the pressure applied to the intermediate transfer member 3. FIG. 4 is an enlarged view illustrating the area close to the contact area (nip region) between the intermediate transfer member 3 and the latent image-supporting member 2 (2*a*, 2*b*, 2*c*, or 2*d*) in FIG. 1.

For example, a metal roller or a metal roller having a coat layer containing a conductor such as carbon dispersed for example in EPDM or NBR may be used as primary-transfer roller.

The secondary transfer voltage V2 is a DC voltage applied to the secondary-transfer roller 15. The secondary transfer voltage V2 applied is, for example, a DC component having a polarity opposite to that of the toner and an absolute value in the range of 300 to 5,000 V, in particular 600 to 3,000 V. AC components may be superposed on the secondary-transfer roller together with DC component.

The secondary-transfer roller 15 for use is, for example, a metal roller having a coat layer containing a conductor such as carbon dispersed, for example, in EPDM or NBR.

The tension roller (10 or 11) is not particularly limited, and, for example, a metal roller of aluminum or iron may be used. A metal roller having a coat layer on the peripheral surface that is made of a conductive powder or carbon dispersed in an elastic material such as EPDM, NBR, polyurethane rubber, or silicone rubber and having a resistance adjusted to $1\times10^9$ Ω·cm or less may also be used.

Other members and devices in the image-forming apparatus according to the present invention, such as the cleaning device 7, electrostatically charging device, exposure device, developing device and cleaning device for latent image-supporting member, are not particularly limited, and any one of those commonly used in conventional image-forming apparatuses may be used.

For example, the developing device may be in one-component development process using only toner or in two-component development process using both toner and carrier.

The toner may contain toner particles produced by a wet method such as polymerization method or by a dry method such as pulverization method.

The average particle size of the toner is not particularly limited, but preferably 7 μm or less, particularly preferably 4.5 to 6.5 μm.

The electrification characteristic of the toner is not particularly limited, and may be negatively chargeable or positively chargeable.

For the viewpoint of reduction of residual image noise, the toner preferably has an absolute electrostatic charge amount of 30 to 70 μC/g, more preferably 40 to 60 μC/g, in any chargeability.

The electrostatic charge amount of toner is determined by the following method:

The toner on the transfer belt before secondary transfer is collected by suction; the charge transfer amount then was determined by using an electrometer; and the electrostatic charge amount of toner is determined by dividing the charge transfer amount with the weight of the toner collected by suction.

EXAMPLES

Preparation of Transfer Belt A

A seamless substrate having a surface resistivity of $1.30\times 10^9\Omega/\square$ and a thickness of 0.15 mm containing carbon dispersed in PPS resin was prepared by extrusion molding.

An acrylic UV-curing resin (Sanrad, manufactured by Sanyo Chemical Industries, Ltd.) containing zinc antimonate dispersed therein at an amount of 3.0 wt % with respect to the total amount was applied on the external surface of the substrate and cured by UV irradiation to form a resin layer having a thickness of 3 μm, to give a transfer belt A.

(Preparation of Transfer Belts B to J)

and set to the values shown in Table 1 for evaluation. The secondary transfer voltage was only a DC component of 1,600 V. The moving distance L of the intermediate transfer member surface from the secondary transfer region to the first primary-transfer region was 400 mm; the moving speed S of transfer belt was 165 mm/second; and L/S was 2.4 seconds. The toner used was a polymerization toner having an average particle size of 6.5 μm, and the electrostatic charge amount was about −50 μC/g on average.

○; No residual image generated at all x; Distinct residual image A generated.

<Improper Transfer of Image and Roughness>

A test was performed in a manner similar to the test for the residual image noise, except that the primary transfer voltage was changed to a DC component at 1,000 V only and the improper transfer and the roughness of image were evaluated.

○; No improper transfer or roughness of image generated x; Distinct improper transfer or/and roughness of images generated

TABLE 1

| transfer belt | Surface resistivity (Ω/□) Substrate | Surface layer (Content[(1)], Thickness) | Volume resistivity (Ω · cm) | Residual potential after L/S seconds (V) | Residual noise V1 = 700 V (*) | V1 = 1000 V (*) | V1 = 1300 V (*) | Improper transfer · Roughness |
|---|---|---|---|---|---|---|---|---|
| A | $1.30\times 10^9$ | $6.05\times 10^{13}$ (3.0% by weight, 3 μm) | $2.24\times 10^{11}$ | 2 | ○ (1/350) | ○ (1/500) | ○ (1/650) | ○ |
| B | $1.30\times 10^9$ | $2.12\times 10^7$ (4.4% by weight, 3 μm) | $1.20\times 10^9$ | 12 | ○ (1/58) | ○ (1/83) | ○ (1/108) | x |
| C | $1.30\times 10^9$ | $1.03\times 10^{11}$ (3.8% by weight, 5 μm) | $4.94\times 10^9$ | 14 | ○ (1/50) | ○ (1/71) | ○ (1/93) | ○ |
| D | $1.30\times 10^9$ | $7.46\times 10^9$ (4.0% by weight, 3 μm) | $2.52\times 10^{11}$ | 18 | ○ (1/39) | ○ (1/56) | ○ (1/72) | ○ |
| E | $1.30\times 10^9$ | $9.46\times 10^8$ (4.2% by weight, 3 μm) | $6.96\times 10^7$ | 24 | ○ (1/29) | ○ (1/42) | ○ (1/54) | x |
| F | $1.30\times 10^9$ | $2.90\times 10^{12}$ (3.4% by weight, 5 μm) | $2.45\times 10^{10}$ | 33 | ○ (1/21) | ○ (1/30) | ○ (1/39) | ○ |
| G | $1.30\times 10^9$ | $1.47\times 10^{13}$ (3.3% by weight, 5 μm) | $1.15\times 10^{10}$ | 42 | x (1/17) | ○ (1/24) | ○ (1/31) | ○ |
| H | $1.30\times 10^9$ | $6.79\times 10^{11}$ (3.7% by weight, 5 μm) | $2.46\times 10^9$ | 61 | x (1/11) | x (1/16) | ○ (1/21) | ○ |
| I | $1.30\times 10^9$ | $4.97\times 10^{12}$ (3.4% by weight, 3 μm) | $3.16\times 10^{10}$ | 103 | x (1/7) | x (1/10) | x (1/13) | ○ |
| J | $1.30\times 10^9$ | $1.00\times 10^{13}$ (3.2% by weight, 5 μm) | $2.70\times 10^{11}$ | 109 | x (1/6) | x (1/9) | x (1/12) | ○ |

[(1)]Content of zinc antimonate:

(*)The ratio of the residual potential after L/S seconds to the primary transfer voltage v1.

Transfer belts B to J were prepared in a manner similar to the transfer belt A, except that the zinc antimonate content and the thickness of the cured resin layer were adjusted so that the surface resistivity and the volume resistivity may be those shown in Table 1.

(Evaluation)

<Residual Potential>

The residual potential on the transfer belt surface after L/S seconds was determined by the method described above under HH environment (30° C. and 85%).

<Noise by Residual Image>

Each transfer belt was mounted in a color image-forming apparatus MFP BizhubC352 (manufactured by Konica Minolta Holdings, Inc.) having the constitution shown in FIG. 1. Immediately after a solid patch image was printed under HH environment (30° C., 85%), a half tone image was printed; and residual images in the printed images were evaluated. The primary transfer voltage was only DC component, <Measurement Method>

The surface resistivity of the substrate and the surface layer were determined by using Hiresta (manufactured by Mitsubishi Chemical Corp.) under NN environment (23° C., 65%). The resistivity of the surface layer was determined, while only the surface layer was formed on an insulative glass plate or PET.

The volume resistivity of the entire transfer belt was determined by using Hiresta (manufactured by Mitsubishi Chemical Corp.) under NN environment (23° C., 65%).

What is claimed is:

1. An image-forming apparatus, equipped with an intermediate transfer member having a surface layer that holds a toner image primary-transferred from a latent image-supporting member temporarily on the surface layer and allows secondary transfer of the toner image held thereon to an image receiving medium, wherein, when the moving distance of the intermediate transfer member surface from the secondary transfer region to the first primary-transfer region is designated as L (mm) and the moving speed of the intermediate transfer member as S (mm/second), the residual surface potential of the intermediate transfer member L/S seconds after application of the secondary transfer voltage is 1/20 or less of the first primary transfer voltage V1.

2. The image-forming apparatus according to claim 1, wherein the intermediate transfer member has seamless belt shape.

3. The image-forming apparatus according to claim 1, wherein the intermediate transfer member has a substrate and a surface layer and the surface resistivity of the surface layer is higher than that of the substrate.

4. The image-forming apparatus according to claim 1, wherein the thickness of the surface layer is 10 nm or more and 5 μm or less.

5. The image-forming apparatus according to claim 1, wherein the residual surface potential of the intermediate transfer member L/S seconds after application of the secondary transfer voltage is in the range of 1/700 to 1/20 of the first primary transfer voltage V1.

6. The image-forming apparatus according to claim 1, wherein the intermediate transfer member has a volume resistivity in the range of $10^7$ to $10^{12}$ Ω·cm.

7. The image-forming apparatus according to claim 1, wherein the intermediate transfer member has a substrate and a surface layer and the surface layer is a hard release layer.

8. The image-forming apparatus according to claim 7, wherein the hard release layer has a hardness of 3 GPa or more.

9. The image-forming apparatus according to claim 7, wherein the hard release layer is an inorganic oxide layer.

10. The image-forming apparatus according to claim 7, wherein the hard release layer is a hard carbon-containing layer.

11. The image-forming apparatus according to claim 7, wherein the hard release layer is a cured resin layer.

12. The image-forming apparatus according to claim 3, wherein the surface layer has a surface resistivity in the range of $10^8$ to $10^{14}$Ω/□.

* * * * *